US006358632B1

(12) United States Patent
Dickey et al.

(10) Patent No.: US 6,358,632 B1
(45) **Date of Patent: *Mar. 19, 2002**

(54) TFEL DEVICES HAVING INSULATING LAYERS

(75) Inventors: Eric R. Dickey; Tin Nguyen; William A. Barrow, all of Beaverton, OR (US)

(73) Assignee: Planar Systems, Inc., Beaverton, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,391

(22) Filed: Nov. 10, 1998

(51) Int. Cl.[7] ..... H05B 33/00
(52) U.S. Cl. ..... 428/690; 428/212; 428/917; 313/509; 257/94
(58) Field of Search ..... 428/690, 917, 428/212; 313/509; 257/94

(56) References Cited

U.S. PATENT DOCUMENTS

| | | | | |
|---|---|---|---|---|
| 4,058,430 A | | 11/1977 | Suntola et al. | |
| 4,188,565 A | | 2/1980 | Mizukami | |
| 4,389,973 A | | 6/1983 | Suntola et al. | |
| 4,486,487 A | | 12/1984 | Skarp | |
| 5,029,320 A | * | 7/1991 | Kido et al. | 313/509 |
| 5,086,252 A | * | 2/1992 | Kido | 313/503 |
| 5,554,449 A | * | 9/1996 | Tonomura et al. | 428/690 |
| 5,598,059 A | * | 1/1997 | Sun et al. | 313/509 |
| 5,675,217 A | * | 10/1997 | Kang | 313/509 |
| 5,677,594 A | * | 10/1997 | Sun et al. | 313/503 |
| 5,712,528 A | * | 1/1998 | Barrow et al. | 313/506 |
| 5,714,274 A | * | 2/1998 | Sugiura et al. | 428/690 |
| 5,804,918 A | * | 9/1998 | Yazawa et al. | 313/506 |
| 5,883,465 A | * | 3/1999 | Inoguchi et al. | 313/509 |
| 5,932,327 A | * | 8/1999 | Inoguchi et al. | 428/212 |
| 5,958,610 A | * | 9/1999 | Yonekawa et al. | 428/690 |

FOREIGN PATENT DOCUMENTS

| | | | |
|---|---|---|---|
| EP | 0 229 627 B1 | 1/1987 | H05B/33/14 |
| JP | 57-28198 | 6/1982 | H05B/33/26 |

OTHER PUBLICATIONS

1987, Society for Information Displays Digest, vol. 87, p. 242, published at least as early as Nov. 9, 1997.

Coovert, et al., Feasability of a Dual–Color ACTFEL Display, 1982, Society for Information Displays Digest, vol. 82, pp. 128–129.

Panicker et al., Light Emitting Film Panels, 1980, Society for Information Displays Digest, vol. 82, pp.112–113.

Tiku, et al., SiA10N—A Composite Dielectric for ACTFEL Displays, 1983, Society for Information Displays Digest, vol. 83, pp. 140–141.

(List continued on next page.)

*Primary Examiner*—Cynthia H. Kelly
*Assistant Examiner*—Dawn Garrett
(74) *Attorney, Agent, or Firm*—Chernoff, Vilhauer McClung & Stenzel, LLP

(57) ABSTRACT

A thin film electroluminescent device has a bottom substrate and a first electrode layer deposited on the bottom substrate. The first insulating layer is deposited on the first electrode layer. A phosphor layer is deposited on the first insulating layer. A second insulating layer is deposited on the phosphor layer. A second electrode layer is deposited on the second insulating layer. In one aspect of the invention, at least a portion of the first insulating layer includes a layer of aluminum titanium oxide, and at least a portion of the second insulating layer includes a layer of a fusing dielectric material. In another aspect of the invention, the first insulating layer includes a layer of a refractory metal oxide, and the second insulating layer includes a layer of a fusing dielectric material.

28 Claims, 4 Drawing Sheets

OTHER PUBLICATIONS

Ohnishi, et al., Blue–Green Color TFEL Device with Sputtered SrS:Ce Thin Films, 1989, Society for Information Displays Digest, vol. 89, pp. 317–320.
Yoshioka, et al., Characteristics of Red Electroluminescent Devices Using $CaS_{1-X}Se_X$:Eu Phosphor Layers, 1989, Society for Information Displays Digest, vol. 89, pp. 313–316.
Ohnishi, et al., Red–Color ACTFEL Devices Using Sputtered CaS:Eu Thin Films, 1988, Society for Information Displays Digest, vol. 88, pp. 289–292.
Nishikawa, et al., A Highly Stable TFEL Panel with CaS Buffer Layer, 1988, Society for Information Displays Digest, vol. 88, pp. 19–22.
Boudreau, et al., Techniques for Dielectric Strength Monitoring in Electroluminescent Display Manufacture, 1988, Society for Information Displays Digest, vol. 88, pp. 12–15.
Hayashi, et al., Thin–Film Electroluminescent Devices Having rf Magnetron Sputtered $SrNb00_2000_6$ Insulating Films, 1987, Society for Information Displays Digest, vol. 89, pp. 249–251.
Ohnishi, Bright–Green TFEL Devices Using Sputtered ZnS:Tb,F, 1987, Society for Information Displays Digest, vol. 87, pp. 238–242.
Sekido, et al., Thin–Film EL Display Panel with Low–and High–Resistivity Insulator, 1986, Society for Information Displays Digest, vol. 86, pp. 171–174.
Yoshida, et al., Stability Improvement of Red–Emitting CaS:EuS Thin–Film Electroluminescence, 1986, Society for Information Displays Digest, vol. 86, pp. 41–43.
Tsujiyama, et al., Bright–Blue Electroluminescence and Hysteresis Behavior in SrS:$CeCl_3$ Thin Films, 1986, Society for Information Displays Digest, vol. 86, pp. 37–40.

Tanaka, et al., Red and Blue Elecroluminescence in Alkaline–Earth Sulfide Thin–Film Devices, 1986, Society for Information Displays Digest, vol. 86, pp. 29–32.

Abe, et al., AC Thin–Film EL Display with $PrMnO_3$ Black Dielectric Material, 1985, Society for Information Displays Digest, vol. 85, pp. 215–217.

Yoshida, et al., AC Thin–Film EL Device That Emits White Light, 1980, Society for Information Display Digest, vol. 80, pp. 106–107.

Takeda, et al., Practical Application Technologies of Thin–Film Electroluminescent Panels, 1980, Society for Information Displays Digest, vol. 80, pp. 66–67.

Kozawaguchi, et al., Low–Voltage–Driven AC Thin–Film Electroluminsecent Devices, 1982, Society for Information Displays Digest, vol. 82, pp. 126–127.

Okamoto, et al., Degradation Mechanism in Thin–Film Electroluminsecent Panels, 1983, Society for Information Displays Digest, vol. 83, pp. 16–17.

Tannas, Failure Modes in ACTFEL Panels, 1983, Society for Information Displays Digest, vol. 83, pp. 14–15.

* cited by examiner

TFEL DEVICES HAVING INSULATING LAYERS

BACKGROUND OF THE INVENTION

This invention relates to thin film electroluminescent devices, and more particularly to thin film electroluminescent devices that utilize new insulator materials and which are made using new processes.

Thin film electroluminescent (TFEL) display devices are well-known. Typically, such devices consist of a substrate on which is deposited a first electrode layer. A first insulator layer, a layer of phosphor, and a second insulator layer are thereafter sequentially deposited on the first electrode layer. A second electrode layer is then deposited on the second insulator layer. A voltage applied across the first and second electrode layers causes the phosphor to luminesce.

TFEL display devices suffer from some common problems. First, the panels are subject to electrical breakdown. Arcing, or "burn-outs," may occur between the electrode layers, thus creating areas of the device which do not luminesce. While some insulating materials fuse and limit the extent of the electrical breakdown, other insulating materials allow the electrical breakdown to propagate throughout the material, thus creating large areas of the device which do not luminesce. Further, if breakdown occurs across an electrode row or column, the entire row or column will fail to luminesce.

TFEL display devices also have several problems related to display characteristics. The panels themselves are not particularly bright. Increasing luminance of the panels typically requires increasing power. However, increasing the power can lead to electrical breakdown. In addition, the luminance of the TFEL display devices has been found to vary over time. This is particularly true in applications involving dimming and gray scale operation. The TFEL devices also exhibit latent images when the pixels or dots should otherwise be on or off. Further, the devices exhibit nonuniformity, with different portions of the devices exhibiting different luminance at the same electrical potential.

In general, two different process types, chemical vapor deposition and physical vapor deposition, have been used to deposit the insulating layers on the TFEL devices. Chemical vapor deposition includes such processes as atomic layer epitaxy, molecular beam epitaxy, thermal CVD and plasma enhanced CVD.

In physical vapor deposition, materials may be evaporated or sputtered to deposit thin films on the electroluminescent devices. Diode sputtering refers to two different sputtering methods: direct current (DC) sputtering and radio frequency (RF) sputtering. In DC sputtering, the target is connected to a negative potential with a positively charged anode present in the deposition chamber. The negatively charged target ejects electrons, which accelerate toward the anode. Along the way they collide with argon gas items, ionizing them. The positively ionized argon atoms then accelerate to the target, initiating the sputtering process.

In RF sputtering, the target is connected to the negative side of a radio frequency generator. The ionization of the gas takes place near the target surface without requiring a conductive target. Radio frequency sputtering is necessary to sputter non-conductive materials and is used also for conductors. Biasing is used with the radio frequency sputtering to achieve a cleaning effect at the film surface. Etching and cleaning are achieved by putting the film at a different field potential than the argon, causing the argon atoms to impinge directly on the film. This procedure is called sputter etch, reverse sputter, or iron milling.

Traditionally, the same manufacturing process, whether physical vapor deposition or chemical vapor deposition, has been used to deposit both of the insulating layers on the TFEL device. For example, in one prior art TFEL display device, first and second insulating layers of silicon oxynitride (SiON) are deposited using RF sputtering (referred to herein as a conventional SiON TFEL device). This TFEL device provides good fusing characteristics in the event of electrical breakdown and good phosphor efficiency. However, the SiON films have many pinholes and provide marginal step coverage over the electrodes. The relatively poor step coverage of the electrodes requires additional thickness for the first insulating layer, and in fact the first insulating layer is generally twice as thick as the second insulating layer. The net result is that while phosphor efficiency in this TFEL device is good, nevertheless these devices require higher threshold voltage and have lower brightness. In addition, while the displays exhibit reasonable display stability, the display characteristics nevertheless change over time.

In another TFEL display device, both the first and second insulating layers are aluminum titanium oxide (ATO), and both are deposited using atomic layer epitaxy. These devices do not exhibit fusing during electrical breakdown, and therefore must be treated with great care. Any significant point contact with the active area results in catastrophic burn-out. Thus, even though ATO has greater electrical strength than SiON, the lack of fusing means that very high dielectric strength margins must be used. Thick films must be used to achieve dielectric strength margins about three times the nominal breakdown field. Phosphor efficiency is poor, and the phosphor uniformity is marginal in dimming or gray scale applications. These devices also experience changes in display performance over time.

Mizukami et al. U.S. Pat. No. 4,188,565 disclose TFEL devices having several different insulating layers. The layers are deposited using diode sputtering. The disclosed ability to conduct reverse sputtering indicates that RF sputtering is used to deposit the layers. Mizukami discloses several devices using tantalum oxide ($Ta_2O_5$) as an insulating layer. In one device, both insulating layers are comprised of a layer of tantalum oxide and a layer of SION. In each insulating layer, the layer of tantalum oxide is adjacent to the electrode, and the layer of SiON is adjacent to the phosphor layer In another embodiment, the first insulating layer is SiON and the second insulating layer is tantalum oxide. In yet another embodiment, the first insulating layer is SiON, and the second insulating layer is $Y_2O_3$.

Suntola et al. U.S. Pat. No. 4,389,973 disclose a method using atomic layer epitaxy to make a TFEL display device. Suntola discloses two devices. In the first, the two insulating layers are tantalum oxide ($Ta_2O_5$). In the second, both insulating layers are Aluminum Oxide ($Al_2O_3$). In both devices, the films are deposited using the same ALE process.

European Patent 0 229 627 B1 discloses a TFEL display device in which both of the insulating layers are $Ta_2O_5$. Both of the $Ta_2O_5$ layers are deposited by sputtering. Alternatively, the patent discloses Barium Titanate ($BaTiO_3$) as the first and second insulating layers.

Yet another prior art TFEL device used a thick film of lead titanate for the bottom insulating layer. The device had a very thin top insulating layer, and in some instances no insulating layer.

Nevertheless, none of the prior art devices have satisfactorily provided a display that combines efficient display performance and high brightness, fusing capabilities in the event of electrical breakdown, and stable display performance over time.

In addition, the processes used to create TFEL devices can be expensive and time-consuming. In order to minimize the display variations and reduce latent image problems, the TFEL devices are typically "burned-in" by subjecting the panels to extended use at high voltages. However, the burn-in time needed to stabilize the image can be quite long, and the amount of power used to burn-in the panels is limited by the ability of the panel to withstand electrical breakdown.

In addition, the manufacturing processes themselves can be expensive. In particular, ALE is a time-consuming and expensive process due to the slow rate of film formation.

What is therefore desired is a TFEL display device which provides high luminance or which can be used at low power, which provides greater reliability and resistance to electrical breakdown, which exhibits fusing in the event of electrical breakdown, which provides uniform and stable display performance over time, and which is cheaper and easier to manufacture.

SUMMARY OF THE INVENTION

The present invention addresses the problems of the prior art. In a first aspect of the invention, a thin film electroluminescent device comprises a bottom substrate and a first electrode layer on the bottom substrate. A first insulating layer is on the first electrode layer, and at least a portion of the first insulating layer includes a layer of aluminum titanium oxide. A phosphor layer is on the first insulating layer. A second insulating layer is deposited on the phosphor layer, and at least a portion of the second insulating layer includes a layer of a fusing dielectric material. A second electrode layer is on the second insulating layer.

In another aspect of the invention, a thin film electroluminescent device has a bottom substrate. A first electrode layer is deposited on the bottom substrate. A first insulating layer is deposited on the first electrode layer. At least a portion of the first insulating layer includes a layer of a refractory metal oxide deposited using DC reactive sputtering, the metal oxide selected from the group consisting of zirconia, hafnia, tantala and niobium oxide. A phosphor layer is deposited on the first insulating layer. A second insulating layer is deposited on the phosphor layer, at least a portion of the second insulating layer including a layer of a fusing dielectric material. A second electrode layer is deposited on the second insulating layer. In a preferred embodiment, the first insulating layer includes a barrier layer between the first electrode layer and the refractory metal oxide layer. In another preferred embodiment, the first insulating layer includes a barrier layer between the refractory metal oxide layer and the phosphor layer. In still another preferred embodiment, the second insulating layer includes a phosphor interface layer.

In another aspect of the invention, a thin film electroluminescent device has a bottom substrate and a first electrode layer deposited on the bottom substrate. A first insulating layer is deposited on the first electrode layer. A phosphor layer is deposited on the first insulating layer. A second insulating layer is deposited on the phosphor layer, at least a portion of the second insulating layer including a layer of a fusing dielectric material and including a phosphor interface layer. A second electrode layer is deposited on the second insulating layer.

Still another aspect of the invention provides a method for manufacturing a thin film electroluminescent device. A first electrode layer is deposited on a substrate. A first insulating layer is deposited on the first electrode layer using DC reactive sputtering. At least a portion of the first insulating layer is a layer of a refractory metal oxide, where the metal oxide is selected from the group consisting of zirconia, hafnia, tantala and niobium oxide. A phosphor layer is deposited on the first insulating layer. A second insulating layer is deposited on the phosphor layer, at least a portion of the second insulating layer including a fusing dielectric material. A second electrode layer is deposited on the second insulating layer. In a preferred method, a barrier layer is deposited between the first electrode layer and the refractory metal oxide layer. In another preferred method, a barrier layer is deposited between the refractory metal oxide layer and the phosphor layer. In another preferred method, the second insulating layer includes a phosphor interface layer.

The foregoing and other objectives, features and advantages of the invention will be more readily understood upon consideration of the following detailed description of the invention, taken in conjunction with the accompanying drawings.

DETAILED DESCRIPTION OF THE PREFERRED EMBODIMENT

Figure 1:
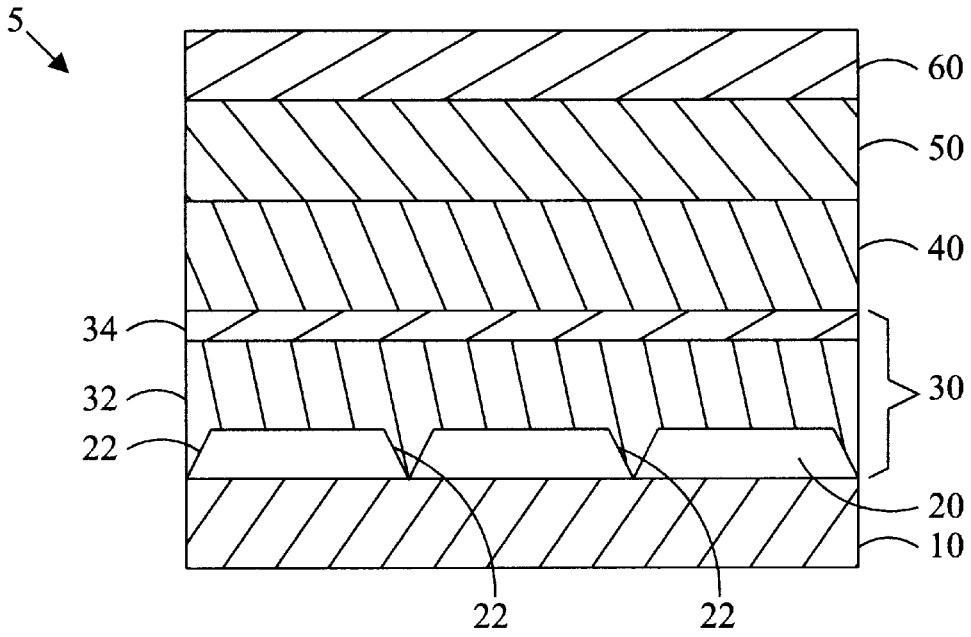
FIG. 1 is a section view of a schematic diagram of a portion of one embodiment of a TFEL device constructed according to the present invention.

Referring now to the figures, wherein like numerals refer to like elements, FIG. 1 shows a TFEL device 5 having a bottom substrate 10 and first electrode layer 20 deposited on the bottom substrate 10. The substrate 10 may be any glass or other material suitable for use as a substrate in a TFEL device. The first electrode layer 20 consists of a plurality of transparent, parallel line electrodes made of indium tin oxide (ITO), or any other material suitable for use as electrodes in a TFEL device. A first insulating layer 30 is deposited on the first electrode layer 20. A phosphor layer 40 is deposited on the first insulating layer 30. The phosphor layer 40 may be any phosphor used in a TFEL device. A second insulating layer 50 is deposited on the phosphor layer 40. A second electrode layer 60 is deposited on the second insulating layer 50. The second electrode layer 60 consists of a plurality of parallel line electrodes perpendicular to the columns of electrodes in the first insulating layer 10. Display electronics (not shown) are used to modulate a voltage across the first and second electrode layers 20 and 60 to cause the phosphor layer 40 to luminesce.

A key to improved performance of the TFEL devices of the present invention was the recognition by the inventors of the contributions of the two respective insulating layers 30 and 50 to device performance. The ability of the device to fuse in the event of electrical breakdown is critical to prevent electrical breakdowns from propagating throughout the device and rendering large areas incapable of luminescence. The inventors have discovered that the first insulating layer 30 contributes almost nothing to the fusing characteristics of the display device. Instead, the fusing characteristics of a TFEL device depend primarily on the second insulating layer 50, and to a lesser extent on the phosphor layer 40. Thus, to achieve superior performance, materials may be selected for the first and second insulating layers 30 and 50 to maximize the contributions of the two layers to device performance.

Because the first insulating layer 30 contributes little to the fusing properties of the device, the material for the first insulating layer 30 may be selected to provide superior electrical strength. It has been found that electrical breakdown typically occurs at the edges 22 of the columns in the first electrode layer 20. Typically, the edges 22 of the electrodes 20 are highly nonuniform, exhibiting sharp edges and rough surfaces, and it is at these nonuniformities that electrical breakdown typically occurs. The first insulating layer 30 therefore should provide good conformal coverage of the electrode layer 20 in order to minimize the possibility of electrical breakdown. In addition, the first insulating layer 30 should have a high "figure of merit." The "figure of merit," as used herein, is the product of the dielectric constant and the electrical breakdown field of the material. A high dielectric constant improves device efficiency by increasing the capacitance of the first insulating layer. A high electrical breakdown field is also desirable, because this improves the ability of the device to be operated at higher electric potentials.

Referring to FIG. 1, in TFEL device 5, the first insulating layer 30 comprises layer 32 and optional layer 34. Layer 32 is a layer of ATO deposited using ALE. It has been found that ATO deposited by atomic layer epitaxy provides good conformal coating of the electrodes. In addition, ATO has a dielectric constant of 16 and a breakdown field of 5.5 (MV/cm), resulting in a relatively high figure of merit of 88. While ALE provides good conformal coverage of the electrodes, other chemical vapor deposition techniques should also produce good conformal coverage.

Because the second insulating layer 50 provides the greatest contribution to fusing, a material is chosen for the second insulating layer 50 which provides good fusing characteristics. Accordingly second insulating layer 50 in TFEL device 5 is a fusing dielectric material such as SiON, which exhibits good fusing characteristics. Other dielectric materials which exhibit fusing include $SiO_2$ and $Al_2O_3$. In contrast, such materials as $TiO_2$, ATO and $Ta_2O_5$ have been found not to provide fusing. Because ALE cannot be used to deposit SiON, the second insulating layer 50 is deposited using physical vapor deposition. This results in an unconventional manufacturing process in which the first insulating layer 30 and second insulating layer 50 are deposited using different deposition processes.

Thus, the present invention combines the best features of the two different types of processes used to make TFEL devices. Surprisingly, this results in a TFEL device having superior electrical strength and fusing capabilities compared to conventional TFEL devices constructed using a single process to deposit both insulating layers. Using ATO in the first insulating layer 30 provides good conformal coating of the first electrode layer 20. In addition, the ATO has a relatively high dielectric constant as well as a relatively large breakdown field. Thus, ATO, as a first insulating layer 30 provides excellent electrical strength. In contrast, the use of SiON in the second insulating layer 50 provides good fusing characteristics. In addition, a relatively thin SION layer can be used as the second insulating layer, avoiding a large voltage drop due to the low dielectric constant of SiON. Thus, the structure takes advantage of the relative strengths of ATO and SiON where they are needed and minimizes their weaknesses.

The TFEL device 5 is constructed using essentially the same process as is used to create conventional TFEL devices using physical vapor deposition for the insulating layers, except for the use of chemical vapor deposition (atomic layer epitaxy) to deposit the first insulating layer 30. Because the ALE process uniformly covers the entire first electrode layer 20, a contact clear must be performed by grinding away or otherwise removing a portion of the first insulating layer 30 to allow electrical contact to the first electrode layer 20. The contact clear may be performed immediately after deposition of the first insulating layer 30, or may be done after the TFEL device is annealed.

In a preferred embodiment, the second insulating layer 30 of the TFEL device 5 includes a layer 34. It has been found that an additional layer 34 of SiON improves the visual quality of the TFEL device 5 at low luminance levels. This thin layer has been found to improve phosphor nucleation uniformity and to reduce or eliminate residue artifacts from the ATO surface of the first insulating layer 30 if the ATO contact clear is done before the phosphor layer 40 is deposited.

EXAMPLE 1

A TFEL device 5 was constructed as follows. A first electrode layer 20 of ITO was patterned on a substrate. A first insulating layer 30 of ATO approximately 1,800 angstroms thick was deposited using atomic layer epitaxy. A 9,000 angstroms thick phosphor layer 40 of ZnS:Mn was then deposited. A second insulating layer 50 of SiON 1,100 angstroms thick was then deposited using physical vapor deposition. A second electrode layer 60 was then deposited on the second insulating layer 50.

EXAMPLE 2

A TFEL device 5 was constructed using the same materials and processes as in Example 1, except including additional layer 34. A layer 34 of SiON 100 angstroms thick was deposited using physical vapor deposition.

The thicknesses of the respective layers may be chosen as desired for particular applications. It has been found that TFEL device 5 can be made with the first insulating layer 30 of ATO reduced to 1,400 angstroms thick and the second insulating layer 50 of SiON reduced to about 700 angstroms for moderate phosphor thicknesses (less than 10,000 angstroms).

Figure 2:
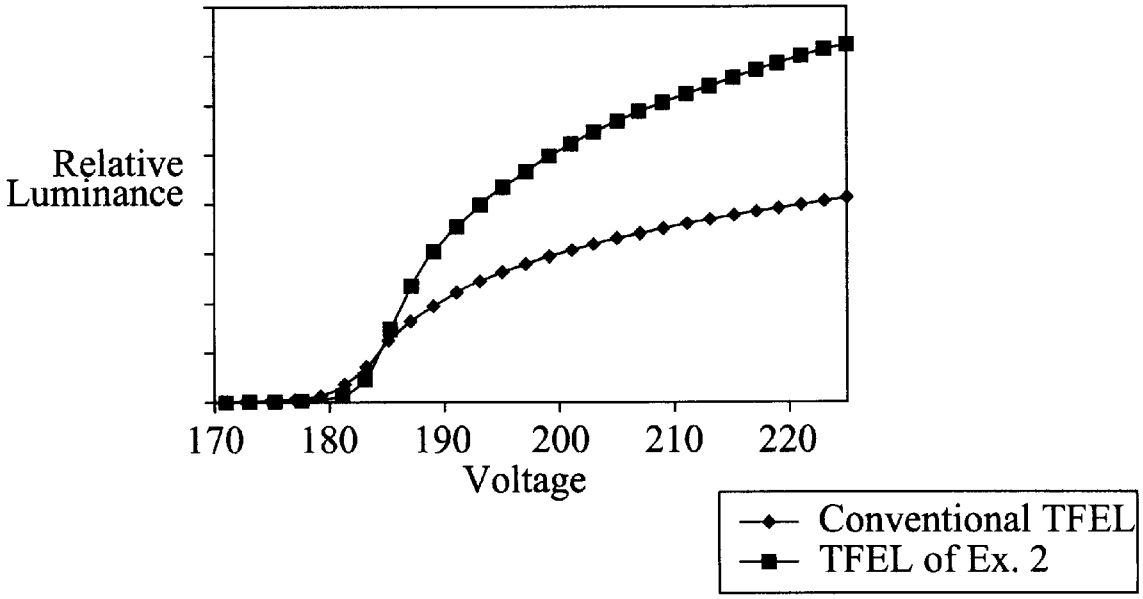
FIG. 2 shows two brightness-voltage curves, one for a conventional SiON TFEL device and the other for a TFEL device of the present invention.

FIG. 2 illustrates the superior performance of the TFEL device 5 of Example 2 compared to a conventional SiON TFEL device. The TFEL device 5 displays superior luminance, and in general such devices are approximately 1.75 to 2 times as bright as conventional TFEL display devices.

The improved electrical strength of the TFEL device 5 compared to conventional TFEL devices allows film thicknesses and/or burn-in conditions to be substantially modified. This leads to several possible display improvements. First, the thickness of the first and second insulating layers 30 and 50 can be decreased to substantially lower the threshold voltage. Alternatively, the thicknesses of the insulating layers and 50 can be reduced, and the thickness of phosphor layer 40 can be increased to produce higher brightness with the same threshold and modulation voltages. This means that the TFEL device 5 can be fabricated with twice the brightness of conventional TFEL displays, or the threshold voltage can be reduced to voltages under 140 volts. Alternatively, such TFEL devices can achieve a more moderate brightness increase in voltage reduction, while allowing for more aggressive burn-in.

While there is no intrinsic phosphor efficiency improvement in this structure, nevertheless the phosphor efficiency of about 2.3 lum/watt is half-way between that of conventional SiON TFEL devices constructed using ATO for the insulating layers 30 and 50. However, for medium to large displays, only a small percentage (about 20%) of the power consumed is used to produce light. Therefore, even if only the device brightness is increased, the resulting display efficiency of TFEL device 5 can be improved. For example, the scan rate or fill factor can be reduced to achieve lower display power for a given display a real luminance.

Figure 3A:
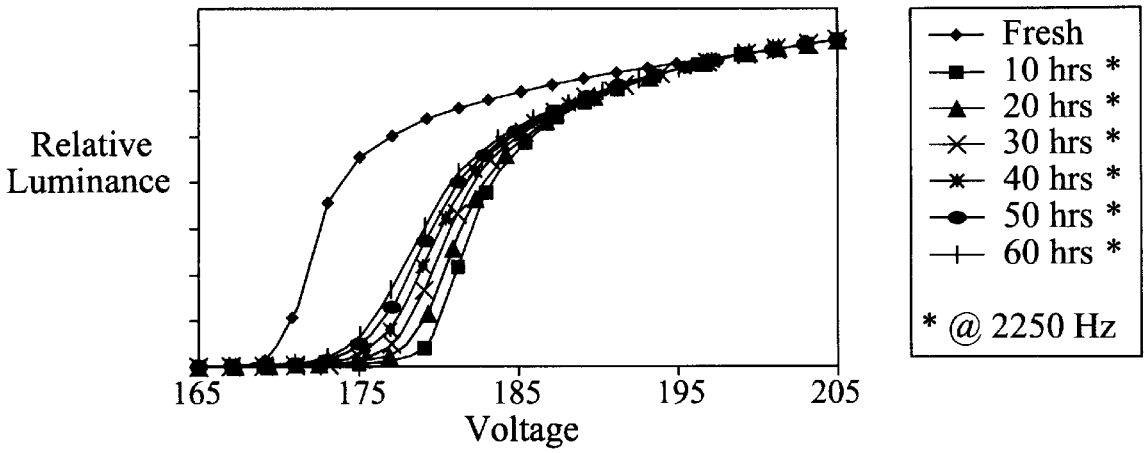
FIG. 3A shows a series of brightness-voltage curves for a conventional SiON TFEL device.
Figure 3B:
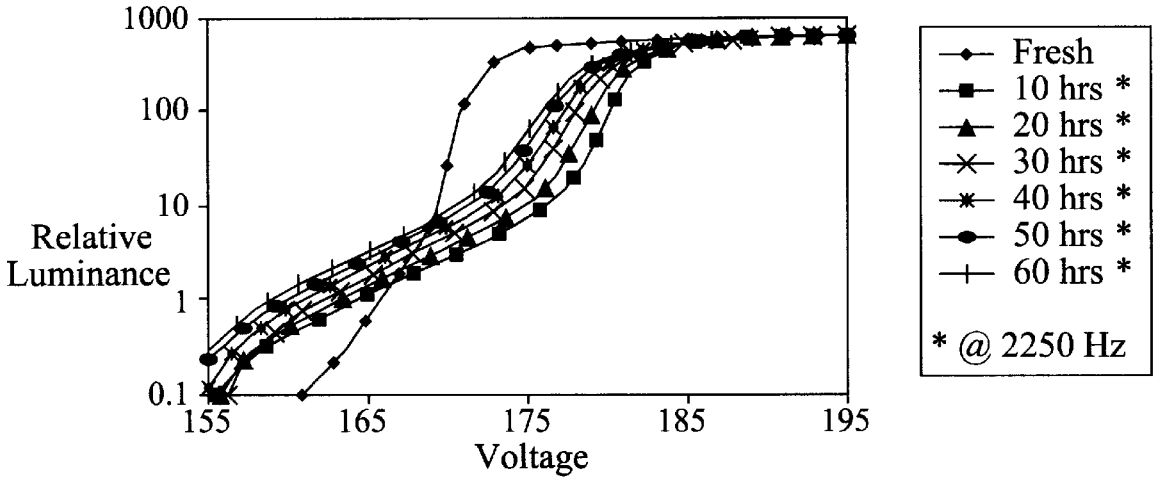
FIG. 3B is a logarithmic plot of the curves shown in FIG. 3A.

Another display improvement results from the capability of the TFEL device 5 to be burned-in under extremely stressful conditions, reducing burn-in time and/or improving the display stability. A second key to improved device performance was the recognition by the inventor of the long term luminance characteristics of TFEL devices. The inventors have determined that conventional TFEL devices undergo a brightness-voltage (B-V) curve shift as the device ages. FIGS. 3A and 3B illustrate a series of B-V curves at different burn-in times for a conventional SiON TFEL device. As shown in FIG. 3A, initially the threshold voltage for luminance increases, and the slope of the B-V curve increases. This is referred to as a "P shift," and is thought to be caused by an initial presence of dynamic space charge in the phosphor near the bottom interface with the first insulating layer, which ages away. It is believed the reduction of this space charge internal to the phosphor leads to the requirement for a higher external voltage for equivalent electrical field in the phosphor layer. Then, after some period of time, the threshold voltage begins to decrease along with a very small decrease in B-V curve slope and peak brightness. This is referred to as an "IN shift," and is thought to occur as a result of the change in the distribution of the trapping depths for electrons at the phosphor to insulator interface. FIG. 3B is a logarithmic plot of the same B-V curve series shown in FIG. 3A. From these curves, the increase in luminance at low voltages is clearly evident, even before the change from the P shift to the N shift in the main body of the B-V curve. This increase reflects the typical bright "off" latent image seen in these types of displays.

Previously, the nature of the B-V curve shift was misunderstood. The long term B-V curve shift reversal (i.e. N shift) had not been appreciated, and the importance of aging voltage and heat had been underestimated. The inventors have found that the burn-in voltage should be greater than the voltage at which the device is operated to eliminate the B-V curve shift. This is due in part to the effects of burn-in on the display electronics, as the effective applied voltage decreases over time due to resistor board drops and electrode resistance drops. Typically, the burn-in process for conventional TFEL devices was not done at elevated voltage, and had only aged the devices part way through the P-shift cycle. Thus, depending on the point in the B-V curve movement cycle, mid-level images could be dark or light, resulting in latent image problems. As the TFEL device continued to age, the D-V curve shift continued, causing changes in luminance for a given potential. Since different portions of the device experienced different use conditions, this leads to nonuniform display characteristics.

Figure 4:
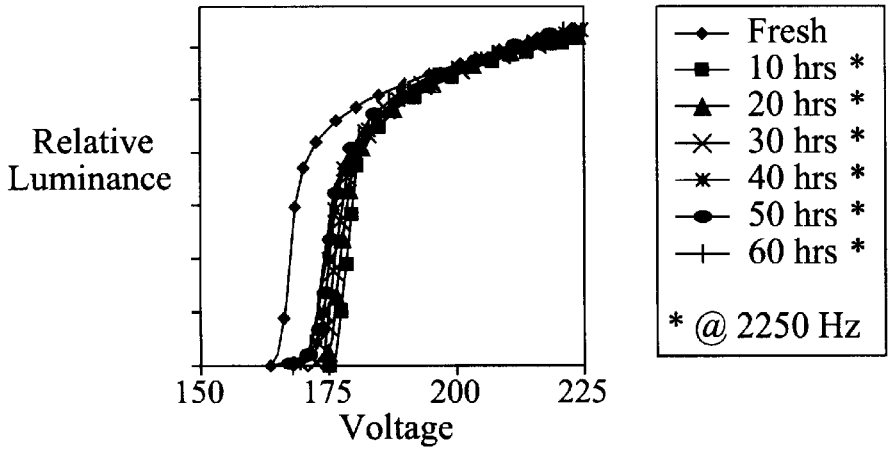
FIG. 4 shows a series of brightness-voltage curves for TFEL device of the present invention.

The key stability improvement in the TFEL device 5 is that the burn-in conditions can be elevated to reach the optimum B-V curve stability in a relatively short period of time. FIG. 4 illustrates a series of B-V curves at different burn-in times for TFEL device 5. As can be seen, TFEL device 5 undergoes both a P shift and an N shift, with only a slight improvement in the N shift over conventional TFEL devices. However, the enhanced electrical strength of the TFEL device 5 allows it to be burned-in at higher potentials and greater frequencies than for conventional TFEL devices. For example, the TFEL device 5 can be subjected to burn-in conditions of 300 plus volts at 350 Hz for over one month without visible degradation. In contrast, conventional TFEL panels typically undergo burn-in conditions of about 240 volts at about 250 hertz.

The increased aging resulting from higher burn-in voltage and higher frequency means substantially shorter burn-in times. For typical TFEL device burn-in conditions, the increasing threshold voltage shift (P shift) may take eight to forty-five days, depending upon the display type and burn-in parameters. The subsequent N shift will then continue for about ten times the P shift duration. For optimum gray level, or dimming stability, the displays should be burned-in until the P shift is almost stopped. The improved electrical strength of the TFEL device 5 over conventional TFEL devices allows this to be done in less than 36 hours, due to the ability to burn-in at increased voltages and frequencies.

Figure 5:
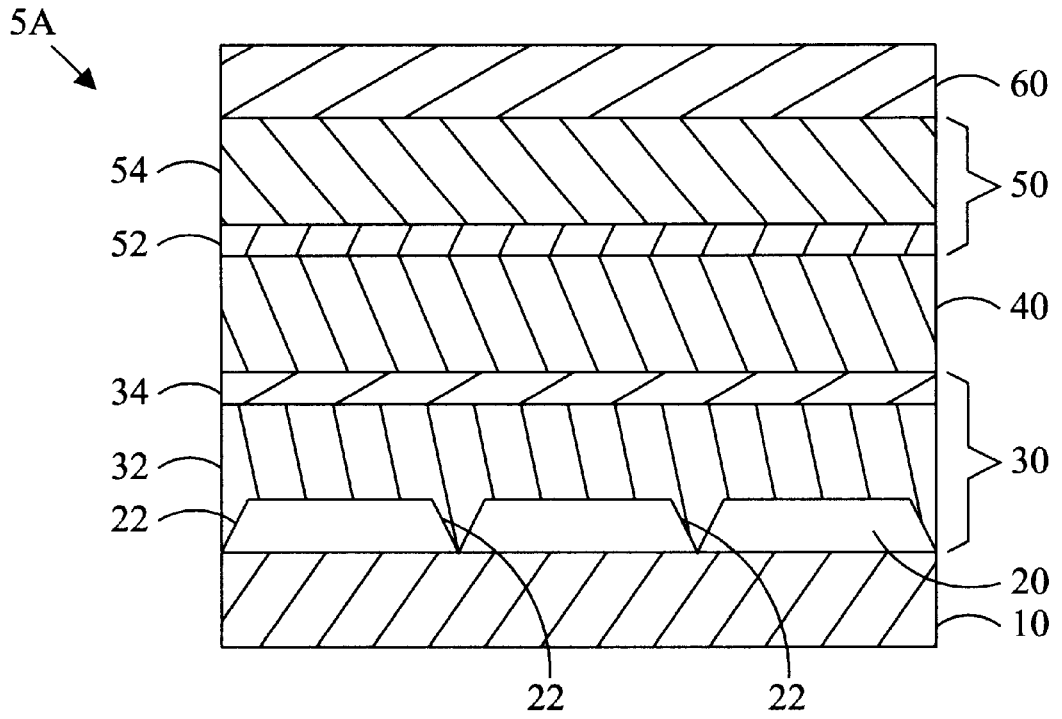
FIG. 5 shows a section view of a schematic diagram of an alternative embodiment of the TFEL device of FIG. 1.

FIG. 5 illustrates yet another embodiment. TFEL device 5*a* is identical to TFEL device 5 except that the second insulating layer 50 comprises two layers 52 and 54. Layer 54 is a layer of a fusing dielectric material, preferably SiON, deposited using physical vapor deposition. Layer 52 is a phosphor interface layer of aluminum oxide ($Al_2O_3$). It has been found that an aluminum oxide phosphor interface layer 52 substantially improves the stability of the B-V curve by reducing the long-term N shift.

While the TFEL device 5 has significant advantages over the prior art, the manufacturing process involves two very different processing steps. The ALE process used to deposit the first insulating layer 30 is time consuming. The use of a different process to deposit the second insulating layer 50 significantly increases the complexity of manufacture because the ALE process is not compatible with the process used to deposit the second insulating layer. In addition, a contact clear must be performed. In short, the ALE process used in the fabrication of TFEL device 5 of FIG. 1 results in added cost and process complexity. In addition, the TFEL device 5 still exhibits changes in the B-V curve over time.

Figure 6:
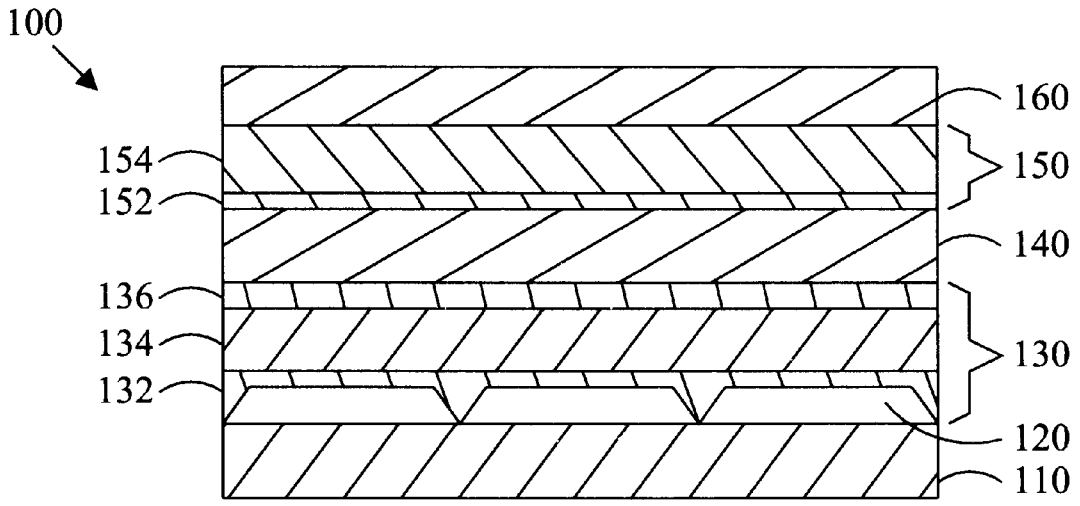
FIG. 6 is a section view of a schematic diagram of still another alternative embodiment of a TFEL device constructed according to the present convention.

Accordingly, another aspect of the invention provides another TFEL device 100 illustrated in FIG. 6. TFEL device 100 has a bottom substrate 110 and first electrode layer 120 deposited on the bottom substrate 110. The substrate 110 may be any glass or other material suitable for use as a substrate in a TFEL device. The first electrode layer 120 consists of a plurality of transparent, parallel line electrodes made of indium tin oxide (ITO), or any other material suitable for use as electrodes in a TFEL device. A first insulating layer 130 is deposited on the first electrode layer 120. A phosphor layer 140 is deposited on the first insulating layer 130. The phosphor layer 140 may be any phosphor used in a TFEL device. A second insulating layer 150 is deposited on the phosphor layer 140. A second electrode layer 160 is deposited on the second insulating layer 150. The second electrode layer 160 consists of a plurality of transparent, parallel line electrodes perpendicular to the columns of electrodes in the first insulating layer 110.

In contrast to the TFEL device 5 of FIG. 1, the first insulating layer 130 is deposited using a physical vapor deposition (PVD) process. PVD offers the advantage of higher throughput than ALE, and the advantage of eliminating the contact clear and use of the same type of process for the second insulating layer. However, because the physical vapor deposition process does not provide the same conformal edge coating of the first electrode layer 120 compared with ATO, it is necessary to select a material for the first insulating layer 130 that has a high dielectric constant to allow thicker films for coverage of the first electrode layer 120. As before, it is necessary to select a material that also has a high electrical breakdown field. In other words, the first insulating layer 130 should again have a high figure of merit, and should be comparable to or exceed the figure of merit for ATO due to the lack of good conformal coverage of the first insulating layer 120.

As shown in FIG. 6, the first insulating layer 130 comprises three layers 132, 134 and 136. These layers consist of a refractory metal oxide layer 134, and two barrier layers 132 and 136. It has been found that four refractory metal oxide materials deposited using DC reactive sputtering may be used for the metal refractory oxide layer 134. These are Zirconia ($ZrO_2$), with a dielectric constant of 23, breakdown field of 3.5 MV/cm, and figure of merit of 80; hafnia, ($HfO_2$) dielectric constant 18, breakdown field 5.8 MV/cm, figure of merit 105; tantala ($Ta_2O_5$), dielectric constant 28, breakdown field 5.5 MV/CM, figure of merit 150; and niobium oxide ($Nb_2O_5$) dielectric constant 50, breakdown field 2.5 MV/cm, figure of merit 125. The inventors have found that the dielectric constant, breakdown field and figure of merit values for these DC sputtered materials are substantially different from the properties published for films of the same materials deposited with RF sputtering from ceramic targets. Thus, the deposition process itself plays a larger role in dielectric properties than the actual choices of materials themselves. All of these materials were evaluated as a first insulating layer 130 and found to provide overall electrical strength equal to or greater than the TFEL device 5 of FIG. 1 having similar threshold voltage and brightness. However, it has also been found that some refractory metal oxides do not work in the first insulating layer 130, such as titanium dioxide and molybdenum oxide.

In addition to improved electrical strength characteristics, the preferred process of depositing the first insulating layer 130 using DC reactive sputtering provides several additional advantages over RF sputtering. DC reactive sputtering eliminates the unmaskable nonuniformity found in large area RF sputtering, and eliminates the need for a sophisticated reactive gas control tailoring required by the oxynitride process. DC reactive sputtering rates are also much higher than for RF deposition of the same materials, and cathode powers can be considerably higher without the risks of severe arcing and substrate interaction.

One preferred refractory metal oxide is $Ta_2O_5$. It has a sufficient dynamic inline sputtering rate to achieve processing speeds two to three times that of conventional manufacturing using the SiON process.

When the refractory metal oxide layer 134 is deposited directly on an ITO first electrode layer 120, the two layers are subject to oxygen exchange when subsequently heated, resulting in a resistivity increase in the first electrode layer 120. This problem is encountered when temperatures exceed 375° C. for long furnace anneals, or approximately 450° C. for typical rapid thermal anneal processes. The oxygen exchange problem can be overcome by depositing a thin barrier layer 132 at the interface between the first electrode layer 120 and the refractory metal oxide layer 134. Materials suitable for use at the barrier layer 132 are SiON, $SiO_2$, $Si_3N_4$ or $Al_2O_3$, in a thickness of 100–300 angstroms. The exact thickness required depends on the material choice and the temperature requirements.

It has also been found that when the phosphor layer 140 is deposited directly in contact with the refractory metal oxide layer 134, adhesion is lost when the TFEL device 100 is annealed at typical phosphor anneal temperatures. The exact temperature at which this occurs depends on the structure of the TFEL device 100, but in general it happens at approximately the same temperature as the ITO electrode layer/refractory metal oxide layer interaction. For the phosphor adhesion problem, a barrier layer 136 of 50 to 200 angstroms of SiON or $Al_2O_3$ provides a film with sufficient adhesion to the phosphor layer 140 to prevent the phosphor from peeling or blistering during most anneals. It is preferred to use aluminum oxide for both barrier layers 132 and 136, primarily due to the same deposition chamber compatibility with the $Ta_2O_5$ process. In a manufacturing process, both materials can be simultaneously run to allow a single pass of the substrates to achieve the desired barrier/tantala/barrier composite.

TFEL device 100 has been made with $Ta_2O_5$ thickness ranging from 800 to 4,000 angstroms, showing good reliability at 1,200 angstroms, and reliability equal to or better than TFEL display device 5 of FIG. 1 for devices having thicknesses of at least 2,000 angstroms. Including the preferred barrier layers 132 and 136, such a composite first insulating layer 130 has a capacitance 25% higher than the ATO first insulating layer used in the TFEL device 5 of FIG. 1 and two and a half times higher than the SiON first insulating layer used in a conventional SiON TFEL device.

A second insulating layer 150 is deposited on the phosphor layer 140, and again the second insulating layer 150 is chosen to provide good fusing characteristics. In TFEL device 100, the second insulating layer 150 comprises fusing dielectric material such as layer 154 and optional layer 152. Layer 154 is a layer of fusing dielectric material such as SiON deposited using physical vapor deposition. Optional layer 152 is a phosphor interface layer of aluminum oxide ($Al_2O_3$). As discussed above, it has been found that a phosphor interface layer 152 of aluminum oxide substantially improves the stability of the B-V curve by reducing the long-term N shift. To get the best stability results, a substantial anneal must also be used with the phosphor interface layer 152. Good results can be achieved with either rapid thermal anneal or furnace anneal, but the best results have been attained with a relatively short duration furnace anneal, held at 525° C. for 15 minutes, with an approximately one hour ramp-up and down.

EXAMPLE 3

TFEL device 100 was constructed as follows. A first electrode layer 120 of ITO was patterned on a substrate 110.

A barrier layer 132 of $Al_2O_3$ 300 angstroms thick was deposited using DC reactive sputtering on the first electrode layer 120. A refractory metal oxide layer 134 of tantalum oxide 2400 angstroms thick was deposited using DC reactive sputtering on the barrier layer 132. A barrier layer 136 of aluminum oxide 50 angstroms thick was deposited using DC reactive sputtering on the layer 134. A phosphor layer of ZnS:Mn 9000 angstroms thick was deposited on the barrier layer 156. A phosphor interface layer 152 of aluminum oxide 300 angstroms thick was deposited using RF sputtering. A layer 154 of SiON 900 angstroms thick was deposited using RF sputtering. A second electrode layer 160 was deposited on the layer 154. The TFEL device was annealed at a temperature of 525° C. for fifteen minutes.

Figure 7:
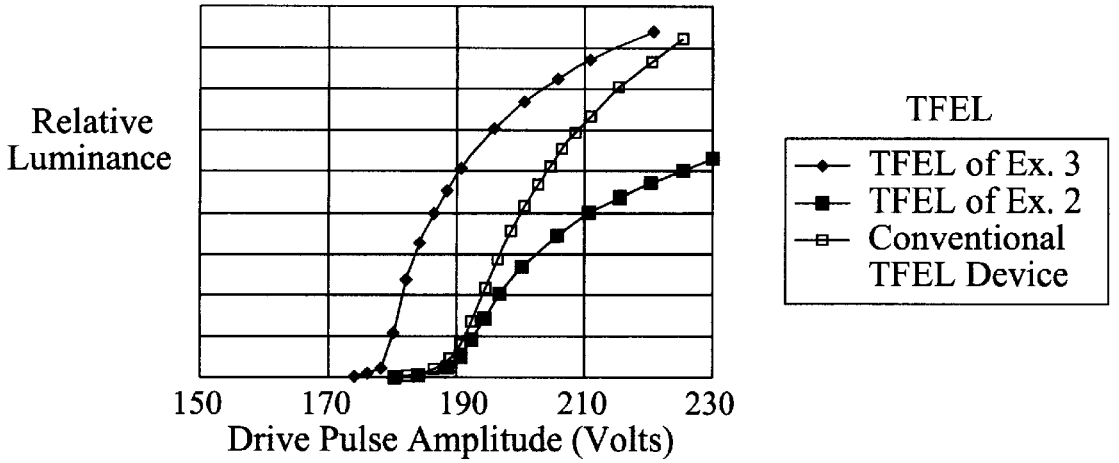
FIG. 7 shows a comparison of the brightness voltage-curves of two embodiments of the TFEL device of the present invention, and a conventional SION TFEL device.

The TFEL device 100 of FIG. 6 shows improved display performance relative to conventional TFEL devices and even the TFEL device 5 of FIG. 1. FIG. 7 illustrates a comparison of the display performance of the TFEL device 100 of Example 3 compared to TFEL device 5 of Example 2 and a conventional SiON TFEL device. As can be seen, the TFEL device 100 has a lower threshold voltage and displays superior luminance compared to both of the other TFEL devices.

Figure 8:
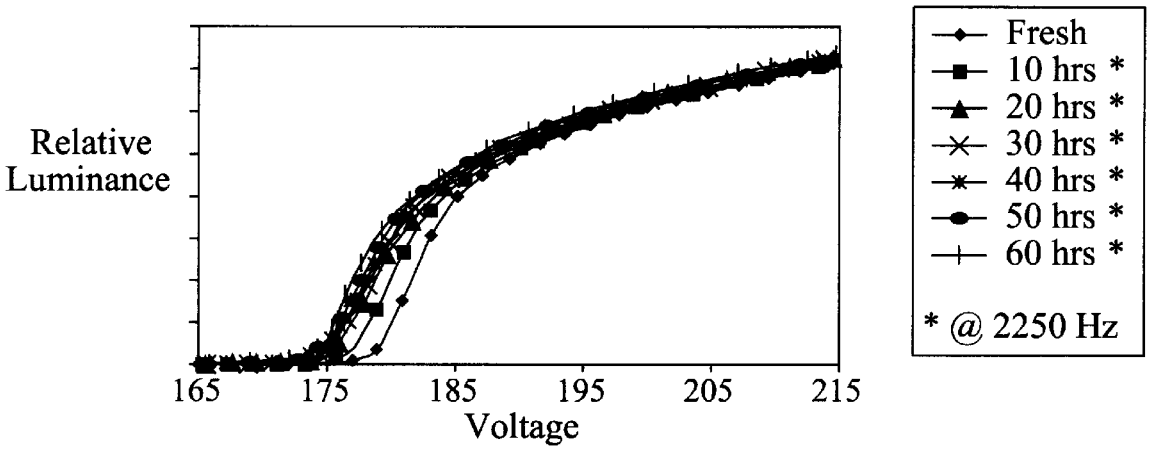
FIG. 8 shows a series of brightness-voltage curves for a TFEL device of the present invention.

The TFEL device 100 also has superior display stability. It has been found that the initial P shift is completely eliminated when the phosphor layer 140 is deposited directly on top of the DC sputtered refractory metal oxide layer 134. FIG. 8 shows a B-V aging curve for a TFEL device having $Ta_2O_5$ as the metal oxide layer 134, with no barrier layers 132 or 136, and SiON as a second insulating layer 150, with no phosphor interface layer 152. The TFEL device was annealed at a relatively low temperature of 375° C. for thirty minutes. As can be seen, the initial N shift is a bit larger than the eventual N shift observed in conventional TFEL devices and in TFEL device 5 of FIG. 1. However, this can be explained by the loss of the competing P shift in the other structures, which would "mask" the larger N shift during the initial aging period. The long-term N shift is about the same as that observed in conventional TFEL devices and in TFEL device 5 of FIG. 1.

When SiON is used as the barrier layer 136 and the anneal temperatures are low (less than or equal to 400° C.), the P shift returns. However, when a high enough anneal temperature is used (e.g., 500° C. furnace or 540° C. rapid thermal anneal), the P shift is again eliminated. In general, a thicker barrier layer 136 requires a higher temperature anneal to eliminate the P shift. Although the exact mechanism is not clear, this general behavior is believed to result from either diffusion or chemical interaction required to overcome the general SiON interface behavior.

It has also been found that reactively sputtered aluminum oxide works well as the barrier layer 136. No specific anneal conditions are required to eliminate the P shift, and the thickness may be chosen simply by the requirements for phosphor adhesion. This is another reason for preferring $Al_2O_3$ as the barrier layer 136. Although this reactively sputtered $Al_2O_3$ is the same compound at the interface as in TFEL device 5 (without the barrier layer 34), the deposition method plays the larger role in determining the device behavior.

Figure 9:
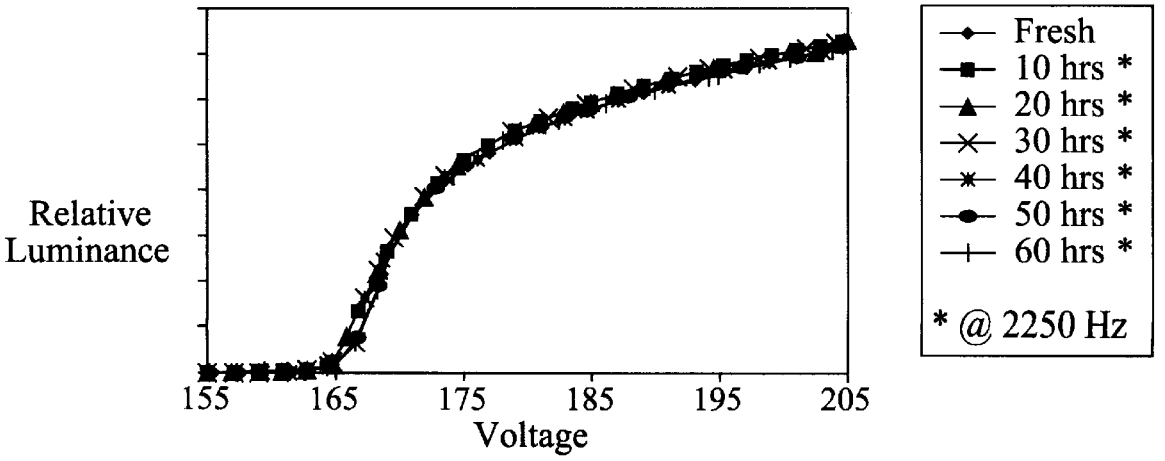
FIG. 9 shows a series of brightness-voltage curves for a TFEL device of the present invention.

In fact, a TFEL device 100 may be constructed which nearly eliminates the B-V curve shift. FIG. 9 shows a series of B-V curves over different burn-in times for the TFEL device 100 of Example 3. As can be seen from the B-V curve in FIG. 9, the P shift and N shift have been practically eliminated.

Accordingly, the TFEL device 100 exhibits superior performance as to both latent image and uniformity to allow gray scale and dimming operations. In addition, the remarkable stability of the B-V curve means that the burn-in time may be substantially reduced or even eliminated. Moreover, due to the high electrical strength of the structure, the TFEL device 100 can be over stressed in a shorter period of time compared to conventional devices to control fusing burn-outs. In addition, due to the B-V curve stability, the on-off latent image performance should be quite good with only a short burn-in time.

Another improvement in display performance is a substantial gain in display efficiency beyond the benefit which comes simply from increased device brightness. This may be achieved by using a process combination which results in a B-V curve with an extremely sharp turn-on and a very stable brightness above mid-level. These characteristics may allow a significant reduction in modulation voltage, which not only reduces power consumption by the display electronics, but also allows the TFEL device to operate at a more efficient point on the B-V curve so that true electroluminescent light efficiency may be increased by thirty to forty percent.

In sum, the TFEL device 100 in FIG. 6 has the following advantages. Like the TFEL device 5 of FIG. 1, it provides higher luminance and/or a lower power requirement. It shows greater reliability due to the use of a first insulating layer 130 having a high electrical figure of merit and the second insulating layer 150 providing fusing capability. In addition, the TFEL device 100 provides improvements over the TFEL device 5 of FIG. 1. The TFEL-device 100 provides for a substantially shorter, less expensive burn-in process. The display performance is exceptional, showing improved display stability with less latent image formation, enabling dimming and gray scale operation without the severe latent image which can occur using conventional processes. It provides lower manufacturing cost which results from the use of physical vapor deposition processes for the first insulating layer 130, which are compatible with the deposition of phosphor layer 140 and second insulating layer 150 and enable fabrication in a single in-line manufacturing deposition system. In addition, the DC reactive sputtering process for simple metal oxide insulators for metal targets results in higher throughput, and a more easily controlled, cheaper process.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An electroluminescent display device comprising:

(a) a bottom substrate;

(b) a first electrode layer deposited on said bottom substrate;

(c) a first insulating layer deposited on said first electrode, at least a major portion of said first insulating layer including a layer of aluminum titanium oxide;

(d) a phosphor layer deposited on said first insulating layer;

(e) a second insulating layer deposited on said phosphor layer, at least a major portion of said second insulating layer including a layer of a fusing dielectric material capable of fusing in the event of electrical breakdown wherein said fusing dielectric material is selected from the group consisting of SiON, $Al_2O_3$ and $SiO_2$; and (f) a second electrode layer deposited on said second insulating layer.

2. The device of claim 1 wherein said aluminum titanium oxide layer is deposited using atomic layer epitaxy.

3. The device of claim 1 wherein said second insulating layer includes a phosphor interface layer.

4. The device of claim 1 wherein said first insulating layer includes a barrier layer of SiON between said aluminum titanium oxide layer and said phosphor layer.

5. The device of claim 4 wherein said second insulating layer includes a phosphor interface layer.

6. An electroluminescent display device comprising:

(a) a bottom substrate;

(b) a first electrode layer deposited on said bottom substrate;

(c) a first insulating layer deposited on said first electrode layer using DC reactive sputtering, at least a major portion of said first insulating layer including a layer of one or more refractory metal oxides wherein said metal oxide is selected from the group consisting of $ZrO_2$, $HfO_2$, $Ta_2O_5$ and $Nb_2O_5$, and has a figure of merit of at least 80;

(d) a phosphor layer deposited on said first insulating layer;

(e) a second insulating layer deposited on said phosphor layer, at least a major portion of said second insulating layer including a layer of fusing dielectric material capable of fusing in the event of electrical breakdown; and (f) a second electrode layer deposited on said second insulating layer.

7. The device of claim 6 wherein said first insulating layer includes a first barrier layer between said first electrode layer and said refractory metal oxide layer.

8. The device of claim 6 wherein said first insulating layer includes a barrier layer between said refractory metal oxide layer and said phosphor layer.

9. The device of claim 7 wherein said first insulating layer includes a second barrier layer between said refractory metal oxide layer and said phosphor layer.

10. The device of claim 7 wherein said first barrier layer is selected from the group consisting of SiON, $SiO_2Si_3N_4$, and $Al_2O_3$.

11. The device of claim 8 wherein said barrier layer is selected from the group consisting of SiON and $Al_2O_3$.

12. The device of claim 6 wherein said refractory metal oxide layer is $Ta_2O_5$.

13. The device of claim 6 wherein said refractory metal oxide layer is $Nb_2O_5$.

14. The device of claim 6 wherein said second insulating layer includes a phosphor interface layer.

15. The device of claim 7 wherein said second insulating layer includes a phosphor interface layer.

16. The device of claim 9 wherein said second insulating layer includes a phosphor interface layer.

17. The device of claim 6 wherein said fusing dielectric material is selected from the group consisting of SiON, $SiO_2$ and $Al_2O_3$.

18. An electroluminescent display device comprising:

(a) a bottom substrate;

(b) a first electrode layer deposited on said bottom substrate;

(c) a first insulating layer deposited on said first electrode layer, at least a major portion of said first insulating layer including a layer of one or more refractory metal oxides, wherein said metal oxide is selected from the group consisting of $ZrO_2$, $HfO_2$, $Ta_2O_5$, and $Nb_2O_5$ and has a figure of merit of at least 80;

(d) a phosphor layer deposited on said first insulating layer;

(e) a second insulating layer deposited on said phosphor layer, at least major a portion of said second insulating layer including layer a layer of a fusing dielectric material capable of fusing in the event of electrical breakdown;

(f) a second electrode layer deposited on said second insulating layer; and (g) a first barrier layer between said first electrode layer and said refractory metal oxide layer and a second barrier layer between said refractory metal oxide layer and said phosphor layer.

19. The device of claim 18 wherein said first barrier layer is selected from the group consisting of SiON, $SiO_2$, $Si_3N_4$, and $Al_2O_3$.

20. The device of claim 18 wherein said second barrier layer is selected from the group consisting of SiON and $Al_2O_3$.

21. The device of claim 18 wherein said refractory metal oxide layer is $Ta_2O_5$.

22. The device of claim 18 wherein said refractory metal oxide layer is $Nb_2O_5$.

23.The device of claim 18 wherein said second insulating layer includes a phosphor interface layer.

24. The device of claim 18 wherein said fusing dielectric material is selected from the group consisting of $SiO_2$, SiON and $Al_2O_3$.

25. An electroluminescent display device comprising:

(a) a bottom substrate;

(b) a first electrode layer deposited on said bottom substrate;

(c) a first insulating layer deposited on said first electrode layer;

(d) a phosphor layer deposited on said first insulating layer;

(e) a second insulating layer deposited on said phosphor layer, said second insulating layer including a layer of SiON and a phosphor interface layer of $Al_2O_3$ deposited directly on said phosphor layer; and (f) a second electrode layer deposited on-said second insulating layer.

26. The device of claim 25 wherein said first insulating layer includes a layer of one or more refractory metal oxides, wherein said metal oxide is selected from the group consisting of $ZrO_2$, $HfO_2$, $Ta_2O_5$, and $Nb_2O_5$ and has a figure of merit of at least 80.

27. The device of claim 25 wherein said first insulating layer includes a barrier layer.

28. The device of claim 27 wherein said barrier layer is between said refractory metal oxide layer and said phosphor layer.

* * * * *

UNITED STATES PATENT AND TRADEMARK OFFICE

CERTIFICATE OF CORRECTION

PATENT NO. : 6,358,632 B1
DATED : March 19, 2002
INVENTOR(S) : Eric R. Dickey et al.

It is certified that error appears in the above-identified patent and that said Letters Patent is hereby corrected as shown below:

Column 6,
Line 13, "… relatively thin SION layer …" should read -- … relatively thin SiON layer … --

Column 7,
Line 11, "… layers and 50 …" should read -- … layers 30 and 50 … --
Line 52, "… referred to as an "IN shift" …" should read -- … referred to as an "N shift" … --

Column 8,
Line 10, "… age, the D-V curve shift …" should read -- … age, the B-V curve shift … --

Column 9,
Line 41, "… field 5.5 MV/CM, …" should read -- … field 5.5 MV/cm, … --

Column 14,
Line 14, "… major a portion …" should read -- … a major portion … --

Signed and Sealed this

Twenty-first Day of June, 2005

JON W. DUDAS
*Director of the United States Patent and Trademark Office*